US007004440B2

(12) United States Patent
Williams et al.

(10) Patent No.: US 7,004,440 B2
(45) Date of Patent: Feb. 28, 2006

(54) REAR SUPPORT SYSTEM FOR DISHWASHER TUB

(75) Inventors: Jeffrey N. Williams, Jackson, TN (US); Daniel Hruby, Jackson, TN (US); Heather M. Hagans, Jackson, TN (US); J. Don Milam, Sugartree, TN (US)

(73) Assignee: Maytag Corporation, Newton, IA (US)

( * ) Notice: Subject to any disclaimer, the term of this patent is extended or adjusted under 35 U.S.C. 154(b) by 236 days.

(21) Appl. No.: 10/410,827

(22) Filed: Apr. 10, 2003

(65) Prior Publication Data

US 2004/0201334 A1 Oct. 14, 2004

(51) Int. Cl.
*F16M 1/00* (2006.01)

(52) U.S. Cl. ..... 248/677; 134/201; 312/228; 312/351.7

(58) Field of Classification Search ..... 248/677, 248/188, 188.1, 188.8; 312/228, 351.7; 134/201
See application file for complete search history.

(56) References Cited

U.S. PATENT DOCUMENTS

| | | | | |
|---|---|---|---|---|
| 1,934,539 | A | 11/1933 | Henderson | |
| 3,834,784 | A * | 9/1974 | Butsch | 312/350 |
| 4,359,250 | A | 11/1982 | Jenkins | |
| 4,746,177 | A | 5/1988 | Lampman et al. | |
| 4,940,298 | A | 7/1990 | Jackson et al. | |
| 5,337,034 | A | 8/1994 | Grimes | |
| 5,613,747 | A | 3/1997 | Becker et al. | |
| 6,045,205 | A | 4/2000 | Dingler | |
| 6,666,531 | B1 * | 12/2003 | Flowers | 312/228 |
| 2003/0184195 | A1 * | 10/2003 | Flowers | 312/228 |
| 2004/0011390 | A1 * | 1/2004 | Flowers | 134/165 |

* cited by examiner

*Primary Examiner*—Ramon O Ramirez
(74) *Attorney, Agent, or Firm*—McKee, Voorhees & Sease, P.L.C.

(57) ABSTRACT

A dishwasher tub is supported and retained on a frame. The rear legs of the frame include lower brackets which support the tub and upper brackets which retain and clamp the tub against movement during shipping. The lower brackets are interconnected by a brace to provide enhanced stability to the frame. The upper brackets and lower brackets are connected together by a male hook on one bracket received in a female slot in the other bracket.

8 Claims, 4 Drawing Sheets

REAR SUPPORT SYSTEM FOR DISHWASHER TUB

BACKGROUND OF THE INVENTION

Dishwasher tubs are generally made of plastic or metal. The tubs are supported by legs so as to be spaced above the floor so there is room for the washing machine components, such as the pump. In a plastic tub, clips are molded into the tub to receive the legs. Such clips cannot be molded into a metal tub. Therefore, metal tubs typically utilize other types of mounting hardware to connect the tub to the legs. Prior art metal tub supports often include special attachments to the tub and/or numerous components that must be assembled and fastened.

Accordingly, a primary objective of the present invention is the provision of an improved rear support system for a metal dishwasher tub.

Another objective of the present invention is the provision of a rear support system for a dishwasher tub which is simple to manufacture, and quick and easy to install.

Another objective of the present invention is the provision of a rear support system for a metallic dishwasher tub which supports and retains the tub on the rear legs of the dishwasher.

A further objective of the present invention is the provision of a dishwasher having an improved rear support system.

Still another objective of the present invention is the provision of a dishwasher having a metal tub and a support system for the tub which prevents the tub from tipping back and forth during shipping.

These and other objectives will become apparent from the following description of the invention.

SUMMARY OF THE INVENTION

The dishwasher of the present invention includes a metal tub with a bottom wall, opposite sidewalls, and a rear wall which define the lower corners of the tub. The tub is supported by a frame including a pair of spaced apart rear legs. A first bracket on each leg receives one of the rear corners of the tub to support the tub. A second bracket on each leg engages a portion of the wall to clamp or retain the tub. The upper and lower brackets sandwich the lower flange or edge of the tub therebetween to retain the tub on the legs. The upper and lower brackets are secured to the leg and joined to one another. A brace extends between the lower bracket to provide stability to the support system.

DETAILED DESCRIPTION OF THE DRAWINGS

Figure 1:
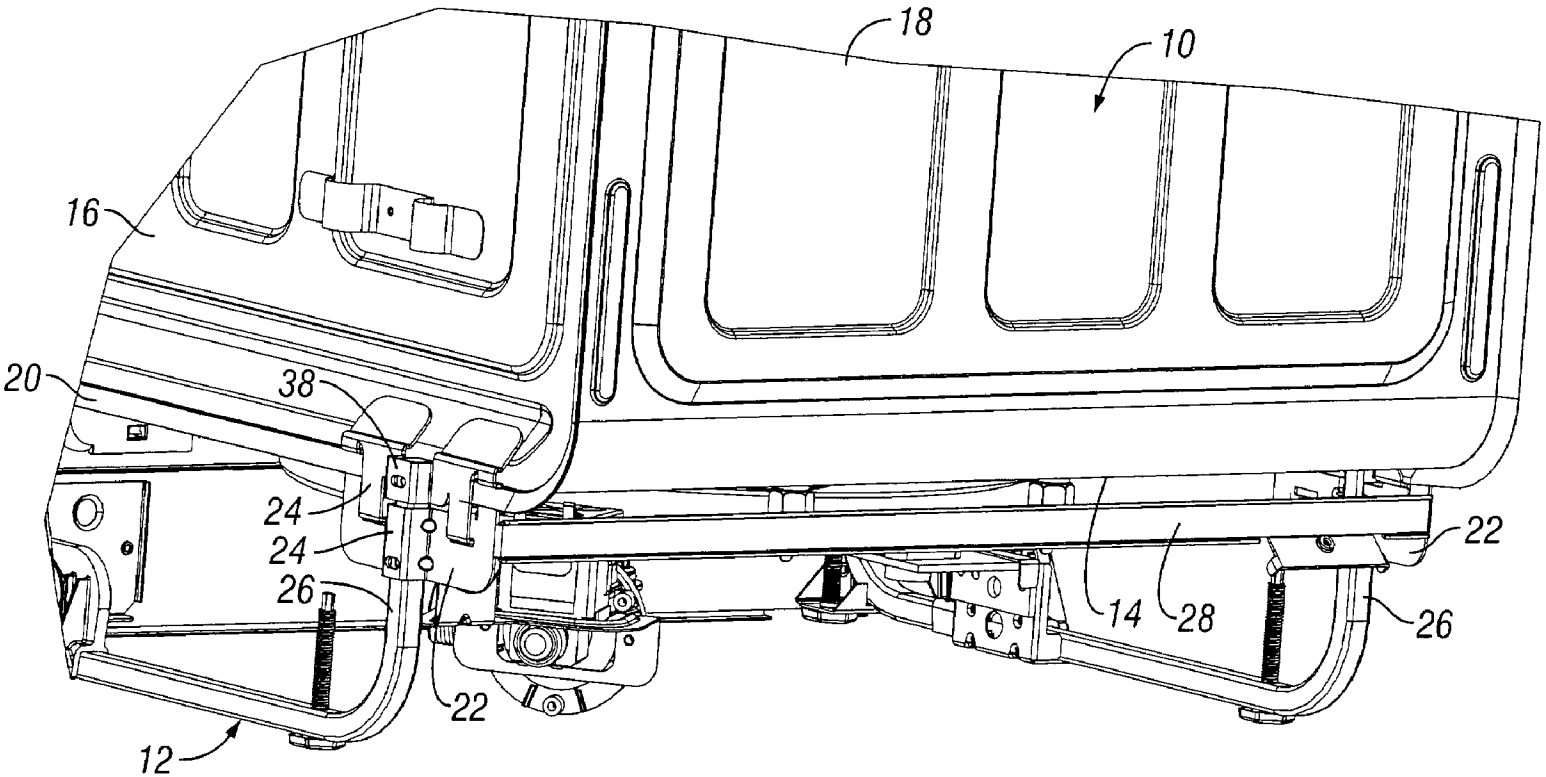
FIG. 1 is a partial rear perspective view of the dishwasher with the rear support system of the present invention.
Figure 2:
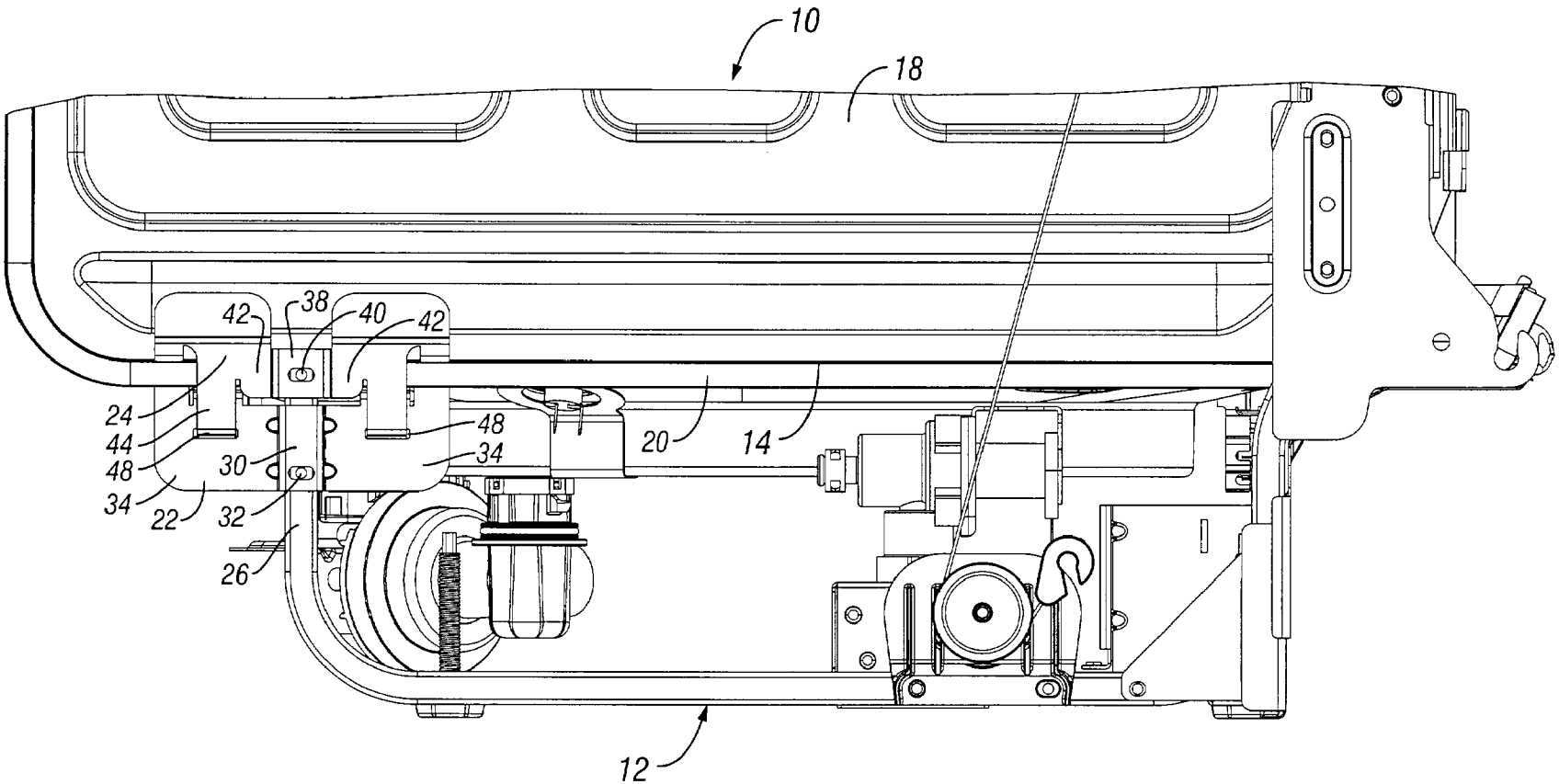
FIG. 2 is a side elevation view of the tub and rear support system.

The dishwasher of the present invention includes a tub 10 supported above the floor by a frame 12. The tub 10 generally includes a bottom panel 14, opposite sidewalls 16, and a rear wall 18. The sidewalls 16 and rear wall 18 join together with the bottom panel 14 to form the lower corners of the tub 10. Preferably, the tub 10 is made of metal, such as stainless steel, with the sidewalls 16 being welded to the bottom panel and terminating in a lower flange 20 on the opposite sides of the tub 10.

The rear support system of the present invention includes a first lower bracket 22 and a second upper bracket 24. A pair of the lower and upper brackets, 22 and 24 are mounted on each leg 26 of the frame 12 adjacent the rear lower corners of the tub 10, as best seen in FIG. 1. The lower flange 20 on each side of the tub 10 is supported on the lower bracket 22 and sandwiched between the lower bracket 22 and the upper bracket 24.

Figure 3:
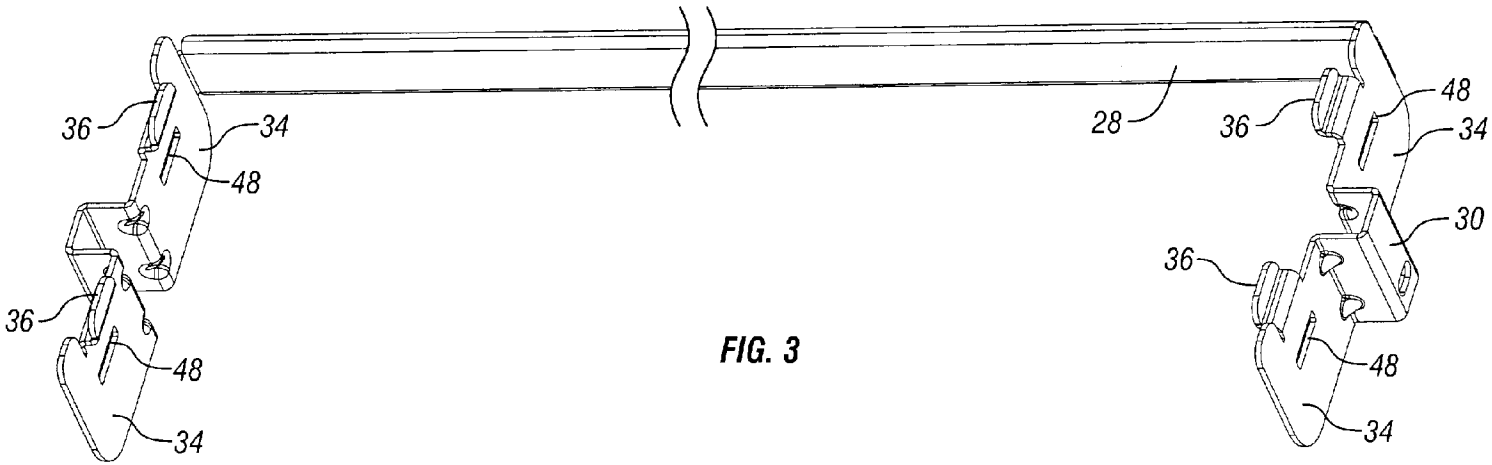
FIG. 3 is a perspective view of the lower support brackets and interconnecting brace.
Figure 4:
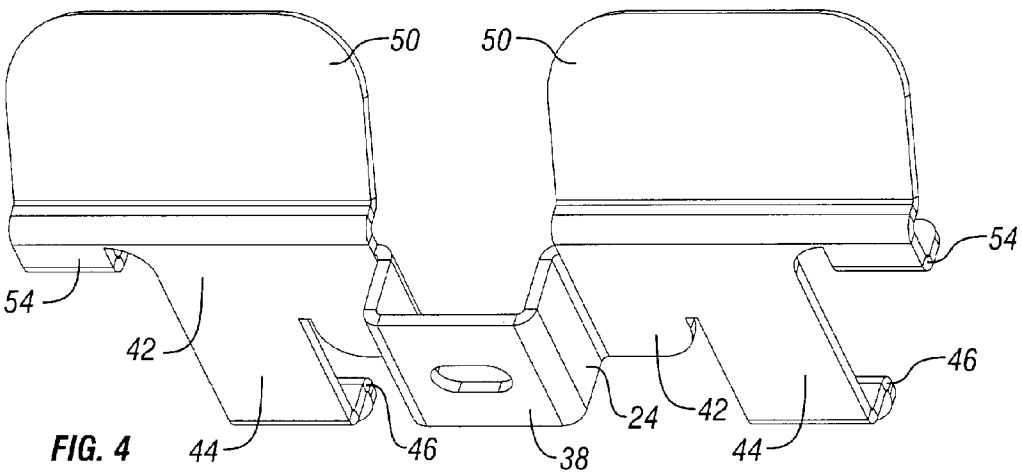
FIG. 4 is perspective view of the upper bracket.
Figure 5:
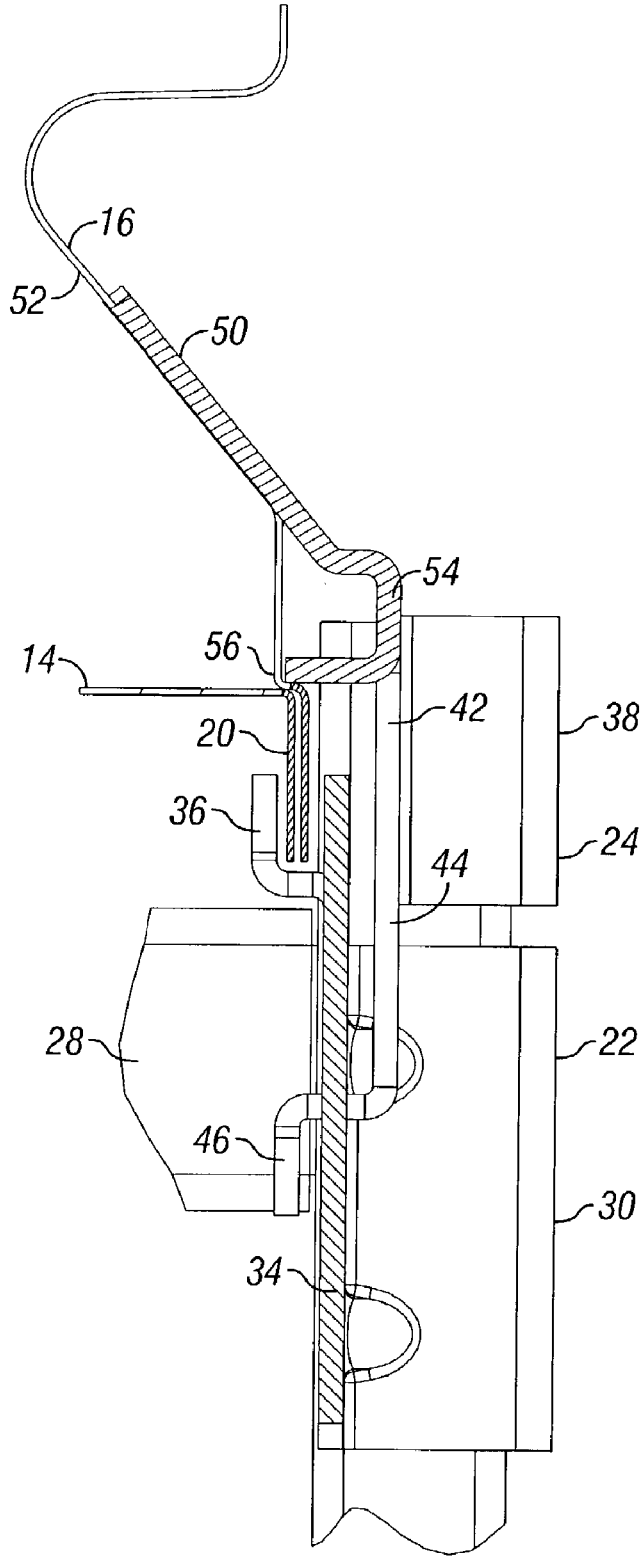
FIG. 5 is a side sectional view showing the bottom flange of the dishwasher tub sandwiched between the upper and lower brackets of the rear support system.

More particularly, as seen in FIG. 3, each of the lower brackets 22 are interconnected by a brace 28 extending therebetween. Preferably, the lower brackets 22 and brace 28 are formed from a single piece of metal. Each of the lower brackets 22 includes a central C-shaped collar 30 which extends around the leg 26 and is secured thereto by any convenient fastener 32. A pair of arms 34 extend outwardly from each side of the collar 30 of the lower bracket 22. An L-shaped tab or support member 36 extends inwardly and upwardly from each of the arms 34, as seen in FIG. 5. The lower edge of the tub flange 20 is received on and supported by the tabs 36 of the lower bracket 22, so as to support the tub 10 on the legs 26 above the floor.

Each of the upper brackets 24 include a C-shaped collar 38 which extends around the leg 26 and is secured thereto by any convenient fastener 40. Each of the upper brackets 24 include arms 42 extending from opposite sides of the collar 38. A leg 44 extends downwardly from each of the arms 42 on the upper brackets 24 and terminates in a lower hook 46 which is received within a slot 48 in the arms 34 of the lower bracket 22.

Each arm 42 of the upper brackets 24 includes an upwardly and inwardly angled extension or retainer member 50 adapted to extend over and matingly engage the flared or sloped portion 52 of the sidewalls 16. Each upper bracket 24 also includes an L-shaped tab 54 adapted to extend over and engage a notch or ledge 56 in the lower flange 20, as seen in FIG. 5.

Thus, the flange 20 of the tub 10 is locked between the tab 54 of the upper bracket 24 and the tab 36 of the lower bracket 22, while the angled extension 50 of the upper bracket 24 clamps the sidewall 16 in a fixed position. Accordingly, the tub 10 is supported on the lower flange brackets 22 and retained by the upper brackets 24 which preclude the tub 10 from tipping forwardly or rearwardly during shipping or other movement.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A support assembly for a dishwasher tub, the tub having opposite side walls each with a lower outwardly flared portion terminating in a lower edge, the support assembly comprising:

a pair of legs;

a pair of lower brackets, each mounted on one of the legs and having at least one arm and at least one support member extending inwardly and upwardly from said at least one arm adapted to extend under the lower edge to support the tub; and a pair of upper brackets, each mounted on one of the legs and having a retainer member adapted to extend over the flared portion of the side wall to retain the tub in position.

2. The support assembly of claim 1 further comprising a brace extending between the lower brackets for stability.

3. The support assembly of claim 1 wherein each upper and lower bracket is secured to the one leg by fasteners.

4. The support assembly of claim 1 wherein each lower bracket includes a slot, and each upper bracket includes a leg adapted to be received in the slot to connect the upper and lower bracket together.

5. The support assembly of claim 1 wherein each upper bracket includes a tab adapted to engage a portion of the lower edge of one of the side walls.

6. The support assembly of claim 1 wherein the upper and lower brackets on each leg are connected by male and female connectors.

7. The support assembly of claim 1 wherein each upper and lower bracket has a collar to fit at least partially around one leg.

8. The support assembly of claim 1 wherein the upper and lower brackets on each leg sandwich the lower edge of the tub therebetween to retain the tub on the leg.

* * * * *